United States Patent [19]

Newton et al.

[11] Patent Number: 4,541,852

[45] Date of Patent: Sep. 17, 1985

[54] DEEP FLASH LNG CYCLE

[75] Inventors: Charles L. Newton, Bethlehem; Wayne G. Stuber, Whitehall; Michael A. Patterson, Lansdowne, all of Pa.

[73] Assignee: Air Products and Chemicals, Inc., Allentown, Pa.

[21] Appl. No.: 579,838

[22] Filed: Feb. 13, 1984

[51] Int. Cl.[4] ..... F25J 3/00

[52] U.S. Cl. ..... 62/11; 62/40; 62/52

[58] Field of Search ..... 62/52, 9, 11, 40, 38, 62/39

[56] References Cited

U.S. PATENT DOCUMENTS 3,763,658 10/1973 Gaumer et al. .
4,225,329 9/1980 Bailey .
4,404,008 9/1983 Rentler et al. .
4,449,994 5/1984 Hegarty ..... 62/39

OTHER PUBLICATIONS

N.E.E.S. Process Description w/Attachments: 211-P-USO2830, Newton/Stuber, sheet one-prior art, sheet two-prior art.

*Primary Examiner*—Frank Sever
*Attorney, Agent, or Firm*—Geoffrey L. Chase; E. Eugene Innis; James C. Simmons

[57] ABSTRACT

A system for liquefying and subcooling natural gas wherein compression power is shifted off the closed cycle refrigerant by subcooling the liquid natural gas to a relatively warm exit temperature and subsequently reducing the pressure and flashing the liquefied natural gas to recover a gaseous phase natural gas in excess of plant fuel requirements, the excess being recompressed and recycled to the feed to the process.

13 Claims, 1 Drawing Figure

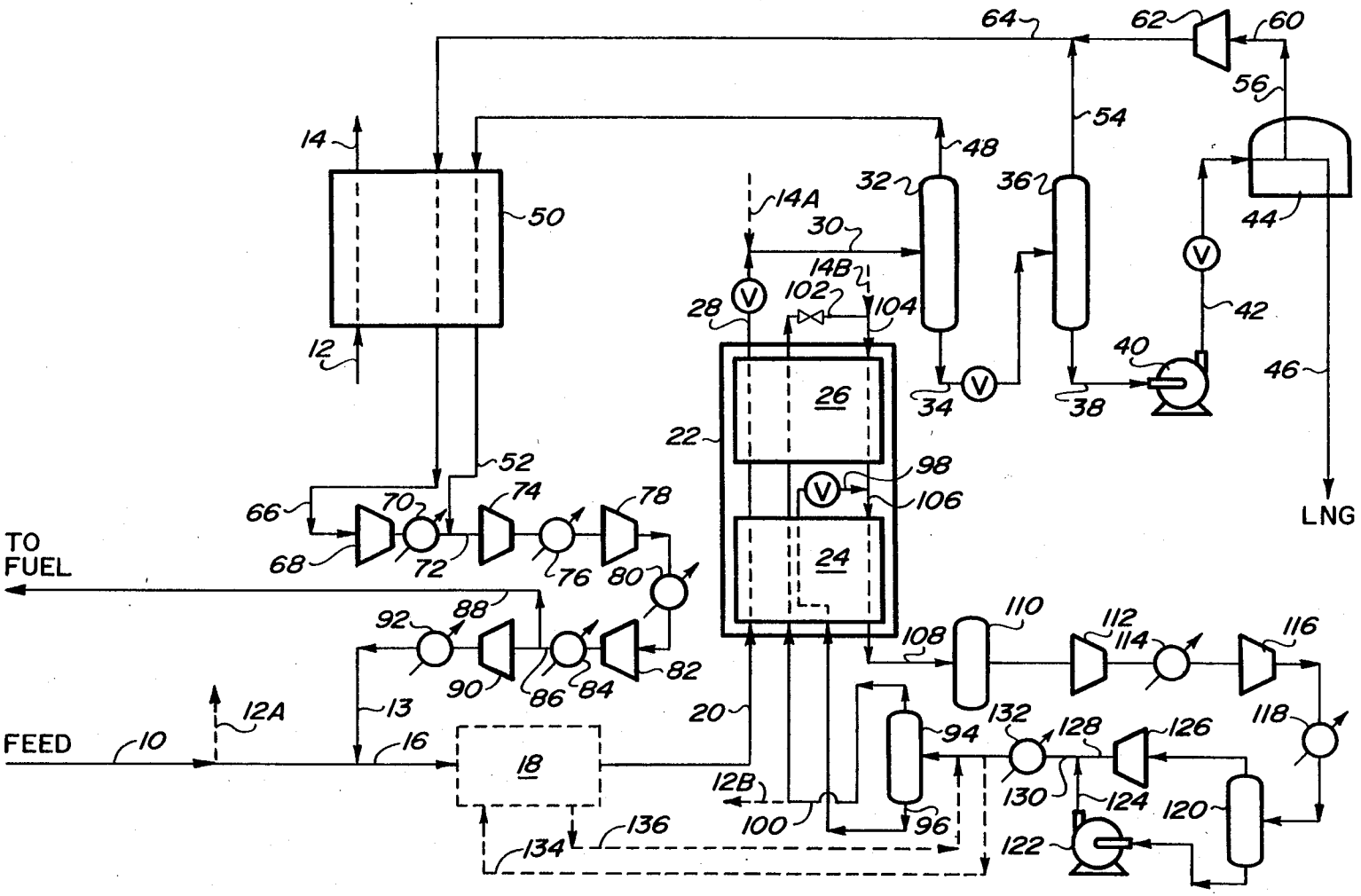
LNG
TO FUEL
FEED

DEEP FLASH LNG CYCLE

TECHNICAL FIELD

The present invention is directed to base load LNG systems. More specifically, the present invention is directed to improving compressor driver balance in a base load LNG plant whereby the power requirements of the plant may be reduced and the liquefaction process may be made more efficient.

BACKGROUND OF THE PRIOR ART

Natural gas has become a major fuel source in the world economy. For fuel deficient regions, the drawback of natural gas as a fuel is the problem in transporting the gas economically from the production site of the gas, usually in remote regions of the world, to the utilization sites, usually the highly industrialized or populated areas of the world. In order to make natural gas a more viable fuel, producers of the gas have utilized large liquefaction plants to cool and condense the produced natural gas for more viable long distance shipment to the end user. Liquefaction requires enormous energy in order to reduce the temperature of the natural gas under cryogenic conditions generally to a temperature of approximately −259° F. In order to make a liquefaction scheme economical, it is necessary to process huge volumes of natural gas under the most efficient conditions possible. The efficiency of a liquefaction process is dependent upon various factors, several of which are the selection of cryogenic machinery available as stock items for such a facility and ambient conditions which exist at the site of the base load liquefaction plant.

Various schemes have been set forth in the prior art for achieving the cold temperatures necessary for natural gas liquefaction. In U.S. Pat. No. 4,225,329 a process is set forth wherein the feed natural gas is initially cooled in one refrigeration system and is subsequently cooled in a cascade refrigeration system whereby the natural gas cools itself by a series of flash stages wherein the rapid reduction in pressure of the natural gas provides cooling with the separation of a liquid phase from a gaseous phase. The gaseous phase is recycled for recompression and introduction into the feed gas stream. A portion of the flashed gas is rewarmed for use as plant fuel. The refrigeration system of this process achieves a partial liquefaction temperature of the natural gas of −141° F. It requires a series of flash stages wherein the natural gas itself provides its own refrigeration in order to cool the liquefied natural gas to the typical storage temperature of −259° F.

The prior art has also sought methods for shifting compression load between dual closed refrigeration cycles in a liquefaction plant. In U.S. Pat. No. 4,404,008 interstage cooling with a propane precool refrigeration cycle of a mixed component subcool refrigeration cycle is performed in order to balance the compressor driver requirements of both the precool and the subcool cycles. This allows the driver motors of a given liquefaction plant to be of the same size and configuration as desired by most plant owners and operators.

A two, closed refrigeration cycle LNG plant is set forth in U.S. Pat. No. 3,763,658 wherein cooling load is exchanged between a propane precool cycle and a mix component subcool cycle.

A typical commercial installation for an LNG plant using only a single, mix component refrigeration cycle is exemplified by the N.E.E.S. installation near Boston, Mass. which went on line in the 1970s.

The present invention overcomes the problem of mismatched compressor drivers, inefficient liquefaction operation and high equipment capital costs by a unique process flowscheme as set forth below.

BRIEF SUMMARY OF THE INVENTION

The present invention is directed to a system for the production of liquefied natural gas wherein a feed natural gas is liquefied and subcooled by heat exchange against a closed cycle refrigerant. The improvement of the present invention comprises subcooling the liquefied natural gas to a relatively warmer temperature than the existing state of the art teaches, reducing the pressure of the subcooled liquefied natural gas and flashing the natural gas in a phase separation in at least two stages wherein a gaseous phase natural gas stream is recovered in excess of that necessary for plant fuel and the excess gaseous phase natural gas is recompressed and recycled to the feed natural gas upstream of the liquefaction and subcooling in order to shift compression power requirements from the closed cycle refrigerant to the compression requirements of the gaseous phase natural gas recycle stream.

Preferably the closed cycle refrigerant comprises a mixture of refrigerant components, such as nitrogen, methane, ethane, propane and butane.

Alternately the closed cycle refrigerant may include two separate closed cycle refrigerant systems wherein a precool cycle is provided with a single component refrigerant, such as propane, or a multiple component refrigerant and a subcool cycle is provided with a multiple component refrigerant.

Preferably, the liquefied natural gas from the above process is delivered to storage wherein the vapors which evaporate from the natural gas storage are also recompressed and recycled with the gaseous phase natural gas recycle stream.

BRIEF DESCRIPTION OF THE DRAWING

The FIGURE illustrates a flowscheme of the system of the present invention wherein alternate embodiments of the flowscheme are represented in dotted line configuration.

DETAILED DESCRIPTION OF THE INVENTION

The present invention in its various embodiments represents a novel base load LNG liquefaction process and apparatus which more evenly balances the compressor power load requirements in order to closely match available driver sizes and thereby more fully utilize the available power of the driver and improve the plant efficiency for LNG production. This is accomplished by liquefying and subcooling a feed natural gas stream to a temperature ultimately warmer than the typical prior art liquefactiion process provides for.

The typical prior art liquefaction process achieved a cold end temperature for the liquefied natural gas in the range of approximately −240° to −255° F. The present invention liquefies and subcools a feed natural gas stream to a slightly warmer temperature in a range of approximately −225° to −235° F. At this warmer temperature, a larger percentage of the natural gas is vaporized to form a gaseous phase natural gas when the pressure on the liquefied natural gas stream is reduced rapidly and admitted to a phase separation vessel. This effects a greater mole fraction evaporation of natural gas which is separated from the liquefied natural gas product of the process. This enlarged mole fraction of gaseous phase natural gas is returned to the process for further treatment.

Typically, at least some portion of the liquefied product of the prior art processes has been evaporated for use as plant fuel. The mole fraction of evaporated natural gas of the present invention considerably exceeds that mole fraction of the liquefied product necessary for plant fuel. It is designed to evaporate and return a sufficient excess of the liquefied natural gas such that the compression equipment for the overall process can be either matched or better fitted to available equipment in the marketplace. This is achieved by liquefying and subcooling the feed natural gas to a warmer temperature. This allows the compression load on the refrigeration equipment to be reduced.

In the case of a single refrigeration cycle, the compression equipment can then be matched with drivers of a reduced capacity and the full capacity of those drivers is utilized for the liquefaction process. This achieves a lower cost over the use of drivers of the next larger size which would be operating at some fraction of their total capacity. The reduction in cold end refrigeration temperatures in the liquefaction plant is compensated for by the recompression requirements of the excess gaseous phase natural gas which is recycled to the front end of the process.

In the case of a liquefaction process utilizing two closed refrigeration cycles, the design of the equipment to provide a warmer cold end temperature for the liquefied natural gas allows the compression equipment of the subcool refrigeration cycle to be matched driver to driver with the compression equipment of the precool refrigeration cycle. This achieves not only efficiency in operation, but a desired reduction in the amount of dissimilar equipment that a plant owner or operator must utilize.

These features of the present invention will be more clearly understood by reference to the preferred embodiments illustrated in the drawing.

The first embodiment of the invention is practiced in conjunction with a single closed refrigeration cycle, which refrigerant utilizes a mixed or multiple component refrigerant composition. The composition is selected for the particular temperatures and duty required in a given installation, but an exemplary composition would include nitrogen 3.4%, methane 27%, ethylene 37%, propane 15% and butane 17.6%. With reference to the FIGURE, a feed natural gas stream at approximately 815 psia and 60° F. is introduced into the system in line 10. The stream has a composition of 97.8% methane, 1% nitrogen, 1% ethane and the remaining percent is propane. The feed natural gas stream is joined by a recycle stream 13, and the combined streams in line 16 are introduced into the main heat exchanger 22 at the warm end in line 20. The main heat exchanger 22 of the present invention is comprised of two bundles, a warm bundle 24 and a cold bundle 26. The bundles comprise stages of the heat exchanger. In the prior art single closed refrigerant cycle, the heat exchanger typically required three bundles in order to produce the colder output temperature of the prior art. With the warmer temperature output of the present invention, only two bundles are deemed necessary with the attendant cost advantage of decreasing the capital cost and fabrication requirements of a heat exchanger bundle.

The feed natural gas stream in line 20 exits the first bundle 24 at approximately −90° F. at 772 psia. The natural gas then enters the cold bundle 26 wherein it is reduced in temperature and liquefied to a relatively warm temperature of −235° F. The stream now in line 28 is reduced in pressure through a valve and conducted in line 30 to a first phase separator vessel 32 wherein a gaseous phase is removed as an overhead stream in line 48 and the liquefied natural gas product is removed as a bottom stream in line 34. An increased amount of natural gas is vaporized in this process due to the relatively warmer temperature of the natural gas stream in line 28 as it exits the main heat exchanger 22. In addition to recovering a greater mole fraction of natural gas in this flash stage, any nitrogen contamination, because of its more volatile characteristic, would generally be removed differentially from the gas stream of line 30, preferentially in the overhead stream in line 48.

The liquefied natural gas product in line 34 is again reduced in pressure through a valve and phase separated in a second phase separator vessel 36, the second phase separation stage of the process. An additional quantity of gaseous phase natural gas is removed in this second phase separator vessel 36 as an overhead stream in line 54. The liquefied product is removed as a bottom stream in line 38. This liquefied natural gas product is pumped to pressure in liquid pump 40 and conveyed in line 42 for storage in LNG containment vessel 44. LNG product can then be removed, as desired, in line 46. As the LNG is stored over a period of time and heat leak occurs in the insulated containment 44, a certain amount of natural gas vaporizes and is recovered in line 56. This vaporous natural gas is collected in line 60 and recompressed in blower compressor 62 to the pressure of the gaseous phase natural gas in line 54. This combined stream in line 64 is recycled for recompression, along with the gaseous phase natural gas from the first phase separation stage now in line 48. The refrigeration value of the streams in line 48 and 64 is recovered in auxiliary heat exchanger 50 against a slipstream of feed natural gas. This slipstream is removed from the feed natural gas stream of line 10 in line 12A. The slipstream in line 12A connects with line 12 in heat exchanger 50, despite the fact that this is not fully illustrated in the drawing. The slipstream is then removed from heat exchanger 50 in line 14 and is reintroduced into the liquefied natural gas stream, presently in line 28, by means of line 14A. Again, the connection between line 14 and 14A is not fully illustrated in the drawing in order to render the various options of the embodiments of the present invention with greater clarity. The recycled gaseous phase natural gas streams now in lines 52 and 66. respectively, emanating from heat exchanger 50 are recompressed for plant fuel and recycle. The lower pressure recycle stream in line 66 from the second stage of flash phase separation is initially recompressed to the pressure of the other recycle stream in line 52 by means of compressor 68 and aftercooler heat exchanger 70, which is operated with an external cooling fluid, such as water. The recycle streams are combined into stream 72 which is further recompressed in three stages in compressor 74, 78 and 82 with interstage aftercooling in heat exchangers 76, 80 and 84. At this point, a plant fuel stream is split out of the recycle stream in line 88, wherein the plant fuel is at a temperature of 60° F. and a pressure of 450 psia. The nitrogen content of this plant fuel stream 88 has been enriched to 12% nitrogen on a mole fraction basis. The remaining recycle stream in line 86 is further compressed in compressor 90 and aftercooled in heat exchanger 92 before being reintroduced into the feed natural gas stream of line 10 by means of line 13. The optional slipstream in line 12A constitutes 7% of the overall feed natural gas.

By increasing the exit temperature of the liquefied natural gas emanating from the main heat exchanger 22 in line 28, the compression power load on the closed mixed component refrigerant cycle is reduced, specifically on the driver load experienced by the various compressors 112, 116 and 126. With less refrigeration required, these compressors perform less work on the mixed component refrigerant.

The mixed component refrigerant cycle works in the following manner. The fully compressed refrigerant in a two phase vapor and liquid stream at 60° F. and 460 psia is phase separated in separator vessel 94. The gas phase refrigerant in line 100 is removed as an overhead and passes through main heat exchanger 22 in warm bundle 24 and cold bundle 26 in a co-current manner to the natural gas feed stream being cooled. The vapor phase refrigerant in line 100 is also cooled to a temperature of approximately −235° F. The stream is fully liquefied as it recycles in line 102 and enters the cold bundle in line 104 wherein it is reduced in pressure through a valve and performs its refrigeration duty at the lowest temperature of the heat exchanger 22. The partially rewarmed refrigerant is combined with the liquid refrigerant from separator vessel 94 and the combined streams in line 106 perform cooling duty at a warmer temperature in the warm bundle 24 of the main heat exchanger 22.

This liquid phase refrigerant from vessel 94 is removed as a bottom stream 96 from said vessel 94 and is cooled in the warm bundle 24 of the main heat exchanger 22 co-currently with the vapor phase refrigerant and the feed natural gas. The cooled refrigerant at approximately −9° F. is reduced in pressure and temperature through a valve in line 98 before being combined with the rewarming refrigerant in line 104. The combined refrigerant streams in line 106 are further rewarmed to a temperature of approximately 55° F. in line 108 before entering a supply reservoir 110.

This refrigerant is then recompressed in compressor 112 and 116, while being aftercooled in aftercooling heat exchangers 114 and 118. The refrigerant is phase separated in separator vessel 120, and the liquid phase is pumped to a higher pressure through pump 122, while the vapor phase is compressed to a higher pressure in compressor 126. The combined streams from line 124 and 128 are further aftercooled in line 130 by aftercooling heat exchanger 132.

The effect of the present invention, wherein warmer exit temperatures are provided for by the flashing and recycle of gaseous phase natural gas in excess of plant fuel requirements, is that compression load can be shifted off of compressors 112, 116 and 126 of the refrigeration cycle in deference to the recompression stages of the recycle streams, including compressors 68, 74, 78, 82 and 90. Therefore, in this instance, with reduced compression load, the drivers which are utilized in the refrigeration cycle may be selected from smaller capacity components and the degree of freedom provided by the recycle network allows for fine tuning of the overall process system such that the drivers can be perfectly matched for the compression load requirements of the refrigeration cycle by the selection of an appropriate exit temperature for the natural gas in line 28 and the corresponding recycle of excess natural gas in lines 48 and 54.

Despite the requirement for additional compression that the recycle stream creates, it has unexpectedly been found by the inventors that the overall power requirements of the base load LNG plant are reduced when drivers can be precisely matched with compression load, as the present cycle allows. The degree of freedom in selecting and manipulating the compression load, which is created by the recycle feature of the present invention, allows drivers to be matched to their capacity under various conditions of flow and ambient weather. Such ambient weather conditions come into play with the aftercooling heat exchangers which are typically run with available ambient water, usually sea water for plants located near coastal transportation sites.

The unique deep flash recycle configuration of the present invention may also be used on other liquefaction process systems other than a single closed cycle refrigerant system. The deep flash configuration may specifically be used on a two closed refrigeration cycle system, such as a propane-mixed component refrigerant liquefaction process. Such an underlying process is set forth in U.S. Pat. No. 3,763,658, hereby incorporated herein by reference.

In such a process identified herein as embodiment 2, the combined natural gas stream in line 16 comprising feed stream 10 and recycle stream 13 is precooled along with the multicomponent refrigerant in a series of staged heat exchangers against a precool closed refrigeration cycle, most specifically a single component refrigerant such as propane. This occurs in station 18 shown in the drawing as a box in dotted line configuration. Streams 134 and 136, also in the dotted line configuration, represent the flow of the multicomponent refrigerant through the first closed refrigeration cycle in station 18 in order to provide a cooling duty between the cycle in 18 and the second multicomponent subcool refrigeration cycle. In this liquefaction scheme, wherein a precool refrigeration cycle and a subcool refrigeration cycle are utilized, a portion of the vapor phase subcool refrigerant from line 100 is removed as a sidestream or slipstream in line 12B. This slipstream of refrigerant passes through auxiliary heat exchanger 50 in line 12 emanating from the exchanger in line 14. This cooled refrigerant stream is reintroduced into the top of the heat exchanger in line 14B, although not shown in complete illustration in the drawing. Therefore, the distinction between this refrigeration system and the prior two embodiments is that a slipstream of refrigerant from the subcool refrigeration cycle is cooled in the exchanger 50, rather than a slipstream 12A of the feed natural gas. The effect of the deep flash recycle invention scheme on a two closed refrigeration cycle liquefaction process is that the deep flash invention allows a degree of freedom in adjusting the refrigeration duty from one closed refrigeration cycle to the other closed refrigeration cycle. In this case, refrigeration duty and therefore compression load may be removed from the subcool cycle and shifted to the precool cycle in stage 18. This allows for similar drivers to be used on the compressors 112, 116 and 126 of the subcool cycle, the same as are used in the compressors of the precool cycle shown without detail as stage 18 (see U.S. Pat. No. 3,763,658).

Alternatively such a dual closed refrigeration cycle with both a precool cycle and a subcool cycle may use two separate mixed or multiple component refrigerants (MR) in a flowscheme similar to embodiment 2.

The benefits of the deep flash invention on the various embodiments of the present invention are set forth in Tables 1 and 2 below.

TABLE 1

| | PRIOR ART N.E.E.S. ALL MR | DEEP FLASH EMBODIMENT 1 |
|---|---|---|
| POWER HP % MR | 100% | 97.8% |
| REFRIG. FLOW m/hr MAIN | 61,273 | 52,111 |
| EXCHANGER AREA % | 100 | 96.3 |
| MAIN EXCHANGER BUNDLES | 3 | 2 |
| INSTALLATION CAPTIAL COST % | 100 | 97.0 |

TABLE 2

| | PRIOR ART U.S. Pat. No. 3,763,658 | DEEP FLASH EMBODIMENT 2 |
|---|---|---|
| POWER HP % MR | 100% | 98.9% |
| REFRIG FLOW m/hr MAIN | 34,605 | 31,398 |
| EXCHANGER AREA % | 100 | 51.6 |
| MAIN EXCHANGER BUNDLES | 2 | 2 |

As can be seen from Table 1 the deep flash invention provides a power savings of 2.2% for the first embodiment in comparison to the multicomponent refrigerant prior art of the N.E.E.S. all MCR® installation in Boston, Mass. As can be seen from the Table, the overall heat exchanger surface area is decreased and the complexity of the fabrication is considerably reduced with the elimination of the typical prior art configuration of three bundles for the configuration of the present invention utilizing two bundles. Therefore, considerable capital savings would be enjoyed by the present invention. Capital cost has been compared on the basis of the main exchanger, water coolers and compressors. In the second embodiment, in comparison to the prior art as set forth in U.S. Pat. No. 3,763,658, a power savings of 1.1% is achieved by the deep flash flowscheme of the present invention. Therefore, it can be seen that the deep flash configuration provides a degree of freedom for the design implementation of base load LNG plants. In the preferred embodiments of 1 and 2 of the present disclosure, a power savings is achieved by the implementation of the deep flash cycle. All of the embodiments should enjoy a capital cost reduction with the reduced complexity of the main heat exchanger.

The present invention has been set forth with reference to various specific embodiments. However the scope of the invention should not be deemed to be limited to such disclosure, but should be ascertained from the claims which follow.

We claim:

1. In a process for the production of liquefied natural gas wherein a feed natural gas is liquefied and subcooled by heat exchange against at least one closed cycle refrigerant, the improvement comprising overcoming the problems of mismatched compressor drivers, inefficient liquefaction operation or high equipment capital costs by subcooling the liquefied natural gas to a relatively warm temperature, reducing the pressure of the subcooled liquefied natural gas and flashing the same in a phase separation in at least one stage wherein a gaseous phase natural gas stream is recovered in excess of that necessary for plant fuel and the excess gaseous phase natural gas is recompressed and recycled to the feed natural gas upstream of the liquefaction and subcooling in order to shift compression power requirements from the closed cycle refrigerant to the compression requirements of the gaseous phase natural gas recycle stream.

2. The process of claim 1 wherein the closed cycle refrigerant comprises a mixture of several refrigerant components.

3. The process of claim 1 wherein the closed cycle refrigerant comprises a first closed cycle refrigerant having a single refrigerant component which precools the feed natural gas and a second closed cycle refrigerant having multiple refrigerant components which liquefies and subcools the precooled gas.

4. The process of claim 1 wherein the closed cycle refrigerant comprises a first closed cycle refrigerant having a mixture of refrigerant components which precools a second closed cycle refrigerant comprising a mixture of refrigerant components which liquefies and subcools the natural gas.

5. The process of claim 1 wherein vapors from liquefied natural gas in storage downstream of the last stage of flashing are recompressed and recycled to the gaseous phase natural gas stream.

6. The process of claim 1 wherein the gaseous phase natural gas stream is recompressed in stages with aftercooling against external cooling fluid before being reintroduced into the feed natural gas stream.

7. In a system for the production of liquefied natural gas wherein a feed natural gas stream is liquefied and subcooled against at least one closed cycle refrigerant in a multiple bundle heat exchanger, the improvement comprising means for overcoming the problems of mismatched compressor drivers, inefficient liquefaction operation or high equipment capital costs including:

(a) means for reducing the pressure of the liquefied and subcooled natural gas including at least one phase separation vessel for removing a gaseous phase natural gas recycle stream;

(b) compression means for recompressing the gaseous phase natural gas from said separation vessel;

(c) means for removing a portion of the recompressed natural gas as plant fuel; and (d) means for introducing the remaining recompressed natural gas into the feed natural gas stream.

8. The system of claim 7 wherein the multiple bundle heat exchanger has two bundles.

9. The system of claim 7 including a precool closed cycle refrigerant stage connected to both the natural gas stream and the subcooling closed cycle refrigerant by heat exchangers.

10. The system of claim 7 including means for recycling vapors from liquefied natural gas storage to the recompression and recycle apparatus of the gaseous phase natural gas stream.

11. The system of claim 7 wherein the means of paragraph (a) includes two separate pressure reduction means and phase separation vessels.

12. The system of claim 7 including a heat exchanger for rewarming the recycled gaseous phase natural gas against process streams.

13. The system of claim 7 including conduit means for recycling the gaseous phase natural gas recycle stream from said phase separation vessel to the feed natural gas stream.

* * * * *